US009969595B1

(12) United States Patent
Wood et al.

(10) Patent No.: US 9,969,595 B1
(45) Date of Patent: May 15, 2018

(54) METHOD AND KIT FOR TYING A KNOT

(71) Applicants: Priscilla Rose Wood, Miami, FL (US); Aaron Vachss Buren, Miami, FL (US)

(72) Inventors: Priscilla Rose Wood, Miami, FL (US); Aaron Vachss Buren, Miami, FL (US)

( * ) Notice: Subject to any disclaimer, the term of this patent is extended or adjusted under 35 U.S.C. 154(b) by 40 days.

(21) Appl. No.: 14/970,342

(22) Filed: Dec. 15, 2015

Related U.S. Application Data

(60) Provisional application No. 62/115,659, filed on Feb. 13, 2015.

(51) Int. Cl.
*B65H 69/04* (2006.01)

(52) U.S. Cl.
CPC ..... *B65H 69/04* (2013.01)

(58) Field of Classification Search
CPC ..... B65H 69/04; B65H 2701/31; D04G 5/00; B65B 13/26
See application file for complete search history.

(56) References Cited

U.S. PATENT DOCUMENTS 2,300,051 A * 10/1942 Lind ..... B65H 69/04 289/1.5
3,624,870 A * 12/1971 Scheff ..... A43D 98/00 24/703.1
4,711,476 A * 12/1987 Hanson ..... B65H 69/04 289/1.2
5,601,197 A * 2/1997 Baxter ..... A47F 5/0006 211/113
5,971,480 A * 10/1999 Maschke ..... A47C 15/008 297/273
6,619,703 B2 * 9/2003 Dirks ..... D04G 1/08 289/1.2
7,331,351 B1 * 2/2008 Asai ..... A41G 3/00 132/53

* cited by examiner

*Primary Examiner* — Ismael Izaguirre
(74) *Attorney, Agent, or Firm* — Simana Rao, Esq.

(57) ABSTRACT

This invention relates to a kit and method for the joining of two separate lives and families into one. The kit and method may be used in conjunction with a marriage, civil union, vow renewal, or other such ceremony between two individuals, and involves the weaving of two individual materials together in a particular manner so as to achieve a knot, symbolizing the union of the two individuals.

17 Claims, 10 Drawing Sheets

METHOD AND KIT FOR TYING A KNOT

CROSS-REFERENCE TO RELATED APPLICATION

The present application relates to, and claims priority to U.S. Provisional Patent Application Ser. No. 62/115,659 filed on Feb. 13, 2015, which is entitled "Unity Knot". The content of this provisional application is incorporated herein in its entirety by reference.

TECHNICAL FIELD OF THE INVENTION

This invention relates to a method, apparatus and kit used to symbolize the joining of two separate lives and families into one. The method may be used in conjunction with a marriage, civil union, vow renewal, or other such ceremony between two individuals, where the method involves the weaving of two individual materials together in a particular manner so as to achieve a knot, symbolizing the union of the two individuals.

BACKGROUND OF THE INVENTION

Wedding unity ceremonies have been in use as part of weddings and civil unions for many years. People from all over the world incorporate unity ceremonies into their weddings because these ceremonies have symbolic and meaningful attributes that enhance the wedding experience and make it unique. In the unity candle ceremony, for instance, the bride and groom each receive a lit candle from their parents and use them to simultaneously light their unity candle. An officiant reads a corresponding ceremony of the couple's choice during this time, and the lighting of the unity candle is viewed as symbolic of the union of marriage. There are many variations of this example, and the end result is a touching addition to the wedding and the candle itself becomes a keepsake for the couple that is considered symbolic of their wedding day.

A second example of an existing wedding unity ceremony is the sand ceremony, which has gained great attention and popularity in recent years. In a sand ceremony, the bride and groom are instructed by the officiant to each pour sand into a vase either one at a time or simultaneously. The sands are considered to be symbolic of the couple and their union of marriage, just as the lighting of the candle in the aforementioned example.

There has been a long felt need for an alternative to the unity candle and sand ceremonies for a variety of reasons. One of these reasons is that many churches and other religious sites restrict the use of candles in weddings because of the fear of fire damage to the property. Another reason is the fact that many weddings are held outside and/or on beaches, and the use of candles and/or sand is difficult, if not impossible, because of the wind or weather, and the difficulty in predicting the weather.

Furthermore, there is a desire to make the wedding ceremony or civil union ceremony a unique experience, to display a unique symbol of the union of marriage and the joining of the families, to include extended family members when applicable, and in doing so create an appropriate keepsake or family heirloom.

The knot tying ceremony method and kit of the present invention advantageously provides a ceremony that can be performed in any weather and any environment including on a ship or under water. It also has the capability to incorporate family members and provide a unique and meaningful experience for the individuals participating in the ceremony as well as guests. The kit of the present invention which contains instructions on creating the knot as well as optional verses to recite during the ceremony, is a useful tool for the individuals participating in the ceremony who often need creative assistance, or do not have the resources or time to devote to preparing certain aspects and details of their event.

SUMMARY

In one general aspect there is provided a method of physically and psychologically joining a first individual and a second individual by forming a double knot, having the steps of providing a first material having a proximal end and a distal end, and a second material having a proximal end and distal end, forming a figure eight shape with the first material such that the proximal end of the first material overlaps with the distal end of the first material and the proximal end lies underneath the distal end, the figure eight comprising a first loop and a second loop which share a common point, where the first loop is continuous and the second loop is discontinuous, threading the proximal end of the first material through the first loop, pulling the distal end and the proximal end in opposite directions to form a first loose knot, following the path of the first material with the second material to form a second loose knot that is adjacent to the first loose knot, forming a double knot and pulling the ends of the first and second materials taut to tighten the first and second knots.

Embodiments of the method may include one of the following features. The first and second materials may be made of rope, twine, yarn, thread, string, ribbon, wire, vinyl, nylon, rubber, leather, plastic, fabric, metal chain, braided metal rope or any combination thereof. For example, the first and second materials are rope. The first material may be a different color from the second material. The proximal and distal ends of the first and second materials may be pre-treated to prevent fraying. The proximal and distal ends of the first and second materials may be pre-treated with a glue, tape or adhesive to prevent fraying.

A third material may be included in the method having a proximal end and a distal end, and following the path of the first material with the third material to form a third loose knot that is adjacent to the first and second loose knots. One or more additional steps may be included of forming one or more additional double knots along the length of the first and second materials at a position adjacent to the double knot. The first material may be grasped by the first individual during the steps of forming the first loose knot. During the step of following the path of the first material with the second material to form a second loose knot, the second material may be grasped by the second individual while the first individual maintains a grip on the first material.

In another general aspect there is provided a kit for physically and psychologically joining a first individual and a second individual by forming a double knot, having the following features: a first material having a proximal end and a distal end, a second material having a proximal end and a distal end, optional verses to recite during the ceremony; and written or graphic instructions for use. The instructions may include the following steps: forming a figure eight shape with the first material such that the proximal end of the first material overlaps with the distal end of the first material and the proximal end lies underneath the distal end, the figure eight comprising a first loop and a second loop which share a common point, wherein the first loop is continuous and the second loop is discontinuous;

threading the proximal end of the first material through the first loop; pulling the distal end and the proximal end in opposite directions to form a first loose knot; following the path of the first material with the second material to form a second loose knot that is adjacent to the first loose knot, forming a double knot; and, pulling the first and second materials taut to tighten the double knot.

Embodiments of the kit may include one or more of the following features. The kit may include instructions provided in the form of an html address which provides the steps of forming the double knot. The instructions may be provided in the form of an html address which includes a video demonstration of forming the double knot or the ceremony itself. The kit may include one or more photographs or drawings depicting one or more steps of forming the double knot. The first and second materials may be made of one or more of rope, twine, yarn, thread, string, ribbon, wire, vinyl, nylon, rubber, leather, plastic, fabric, metal chain, braided metal rope or any combination thereof. For example, the first and second materials may be rope. The proximal and distal ends of the first and second materials may be pre-treated to prevent fraying. The proximal and distal ends of the first and second materials may be pre-treated with glue, tape or adhesive to prevent fraying. The instructions may include a step whereby the first material is grasped by the first individual during the steps of forming the first loose knot. The instructions may also include a step during the step of following the path of the first material with the second material to form a second loose knot, the second material may be grasped by the second individual while the first individual maintains a grip on the first material.

DETAILED DESCRIPTION

Figure 1:
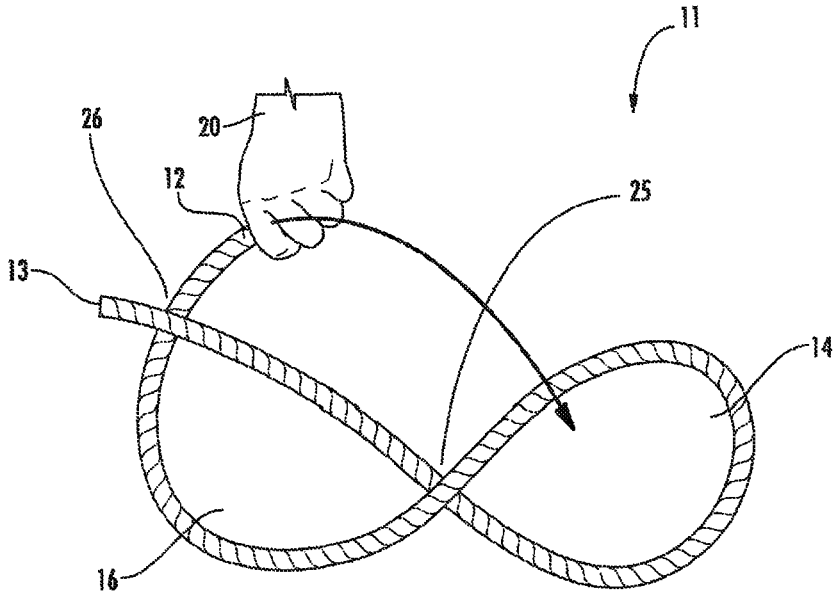
FIGS. 1-8 illustrate the steps described as steps 1-8 of forming the knot of the present invention.

Referring to FIGS. 1-8, the steps of forming the knot 10 are provided in detail. The knot is meant to be formed by two individuals intending to make or renew a life commitment to each other, and is preferably performed in the presence of one or more witnesses and/or family members and/or an officiant. Alternatively, the knot may be formed without other individuals present, according to the wishes of the users (the two individuals participating in the above-mentioned ceremonial act). As will be explained in detail below, knot 10 is formed by the weaving of a first material into a first knot and the juxtaposition and weaving of a second material into a second knot which is in constant contact with the first knot. Therefore, knot 10 may also be referred to as a double knot, with the double knot being associated with having greater strength than any single knot, providing a meaningful representation of the unity of marriage.

A first material 11 and second material 15 (shown in FIG. 10) are provided and generally have a tubular or rope-like shape, though it is envisioned that the material may also be an elongated rectangular piece of fabric, a chain with links, or a braided element, and therefore the shape of the materials may take on a variety of forms. Non-limiting examples of the first material 11 and second material 15 are rope, twine, yarn, thread, string, ribbon, wire, vinyl, nylon, rubber, leather, plastic, metal chain, braided metal rope or any combination thereof. Furthermore, the first material and second material may be constructed of the same or different materials. Preferably, the two materials are different from each other in at least one way, such as by color, pattern, thickness, diameter, or material used.

Preferably, the two materials have a similar or same length, although it is considered an embodiment of the invention for the materials to be of differing lengths. For example, the length of the two materials may range from approximately 6 inches to 60 inches, preferably from 30 inches to 54 inches, and most preferably from 36 inches to 48 inches. When a rope is being used as the material, the rope may have a diameter of between about 0.01 mm to about 76 mm, preferably from about 2 mm to about 40 mm and most preferably from 5 mm to about 25 mm.

Furthermore, when rope, string, or fabric is used as the material, the two ends of the material may be altered using a variety of methods to prevent fibers from unraveling, uncurling, fraying, and/or to otherwise prevent ends that are visually unpleasing. For example, if the material is a synthetic material such as polyester, ends of the rope or the portion of the fabric/ribbon that has been cut may be heat or flame treated by applying a flame such that the individual cut fibers may fuse together.

Alternatively, such as for materials which are made from natural fiber, such as sisal, manila, coir, hemp, flax, cotton, jute or hessian, a sealing material may be applied to each end, such as tape, glue, hot glue, or another kind of adhesive. In another embodiment, a finer rope, string or twine may be wrapped around each end of the rope. Preferably, the twine is wrapped in the opposite direction of the direction that the rope is wrapped. If the material is a fabric, a seam can be made at the cut portions using a sewing technique, a no-sew adhesive or double sided tape.

In yet another embodiment, decorative brass, gold, silver, or other material end cap may be glued to the ends of the rope. This kind of finishing would be especially advantageous in the case that rope is used as the material as it would provide an ornamental finishing to the rope which could be customizable based on the users' preference, such as if a match to a preexisting theme or color scheme is desired. Additional decorative elements could be secured to the end caps, such as a jewel, colored stone or bell. Such end caps may also serve to weigh down the rope at its two ends and therefore could provide an advantage of being easier to manipulate and form the knot 10 for the users.

The above-described embodiment of altering the ends of the first material 11 and second material 15 is important especially in the case that the users desire to keep the inventive knot for a number of years after the ceremony is performed. However, in some cases it may not be desirous to alter the ends of the material to achieve a particular aesthetic appearance, for example.

Turning to FIG. 1, the first material 11 is provided having a proximal end 12 and a distal end 13. The proximal end 12 of the first material 11 is typically the end that the user leads with and/or manipulates to form the knot 10. A first user 20 forms a FIG. 8 shape with the first material 11 such that the proximal end of the first material overlaps with the distal end of the first material at point 26 and the proximal end lies underneath the distal end. Step 1 is depicted in FIG. 1 and shows the FIG. 8 shape which includes a first loop 14 and a second loop 16 which are formed by the intersection of the first material with itself at point 25 as is required to form a FIG. 8 shape. Loop 16 is formed by the two portions of material lying between points 25 and 26. Loop 16 is therefore a discontinuous loop formed from two separate portions of material due to the crossing of the first material at point 26. Loop 14 is a continuous loop, formed from the first material starting at intersection point 25, following the natural bending of the first material that occurs to create the FIG. 8, and ending at intersection point 25.

Figure 2:
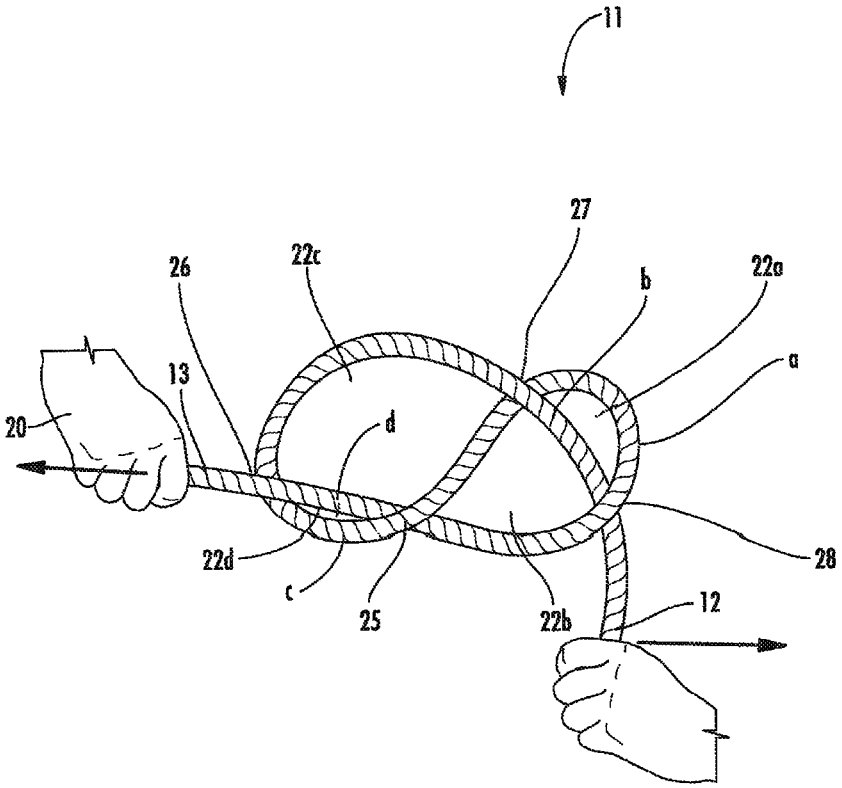
Figure 3:
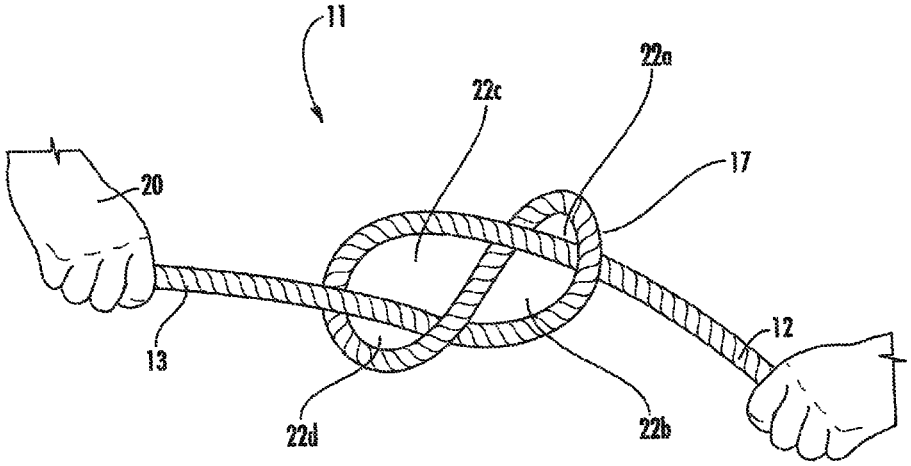

The proximal end 12 of the first material is then threaded through loop 14 as shown in FIG. 2 which depicts step 2. The proximal end 12 and the distal end 13 of the material are then pulled in opposite directions so as to pull the material taut and/or apply longitudinal tension to the material along its length, thus forming a loose first knot 17 as shown in FIG. 3 which depicts step 3. It should be noted that the pulling action should not apply too much outward force such that these openings between turns and intersections of the rope cannot be seen.

FIG. 3 shows the first knot 17 being loose and including four openings 22*a*, 22*b*, 22*c* and 22*d* which are formed as a result of the turns and intersections of the first material with itself after pulling the proximal end 12 through loop 14. As the proximal end 12 of the first material is pulled through loop 14, the trailing portion of the first material crosses the loop 14 at two points, point 27 and point 28, shown in FIG. 2. Point 27 is located distal to point 28 along the length of the first material, as can be seen in FIG. 2. The crossing of the material across loop 14 forms two openings 22*a* and 22*b*, as shown in FIG. 2. Opening 22*a* is formed from the portion of material starting at intersection point 27 to point 28 which is substantially curved (shown as portion a) and following in a clockwise direction the portion of material from point 28 back to point 27 (shown as portion b). Opening 22*b* is formed from the portion of material starting at intersection point 27 to point 28 (portion b), the portion of material from point 28 to 25 and the portion of material from point 25 to point 27. It should be noted that portion b is proximal to portion a along the length of the first material 11.

Opening 22*d* is formed from the substantially curved portion of material from point 25 to point 26 (portion c) and following in a clockwise direction the portion from point 26 to point 25 (portion d). Opening 22*c* is formed from the portion of material from point 25 to 26 (portion d), and following in a clockwise direction the portion of material from point 26 to point 27 and the portion of material from point 27 to 25. Step 3 in FIG. 3 shows each opening 22*a-d* and portion a-d.

Figure 4:
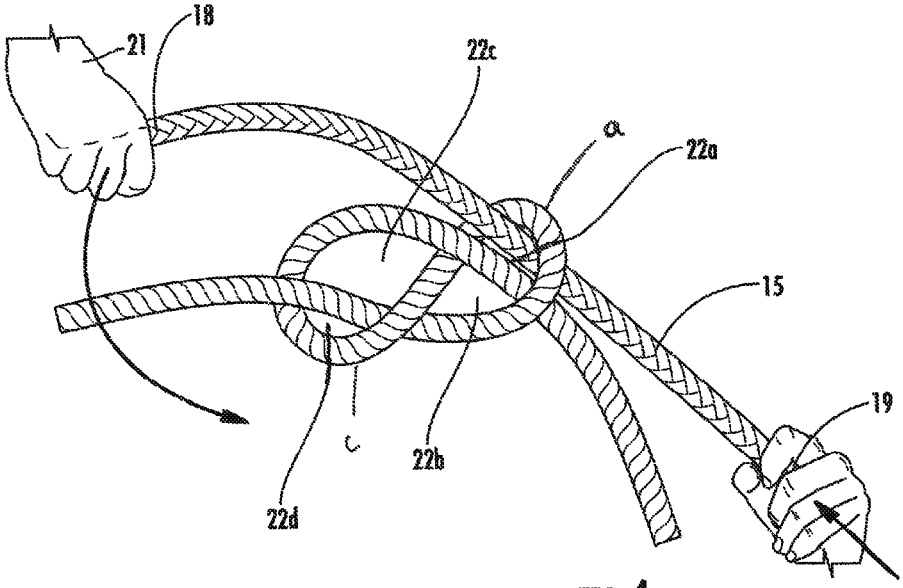
Figure 5:
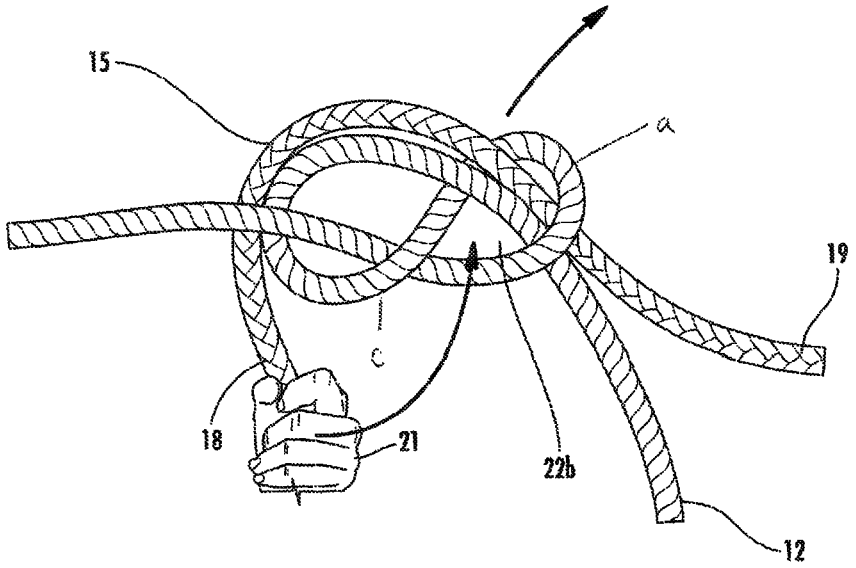
Figure 6:
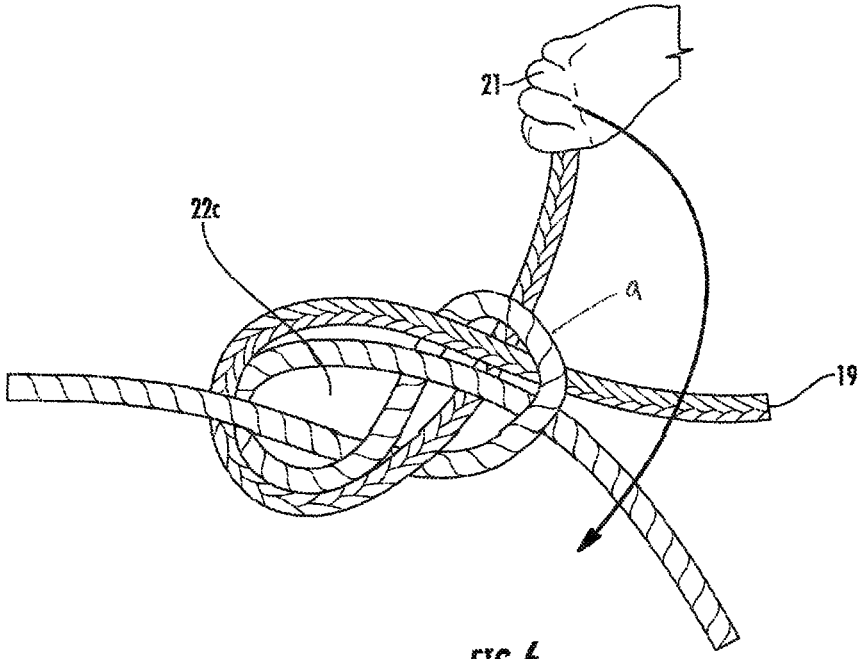
Figure 7:
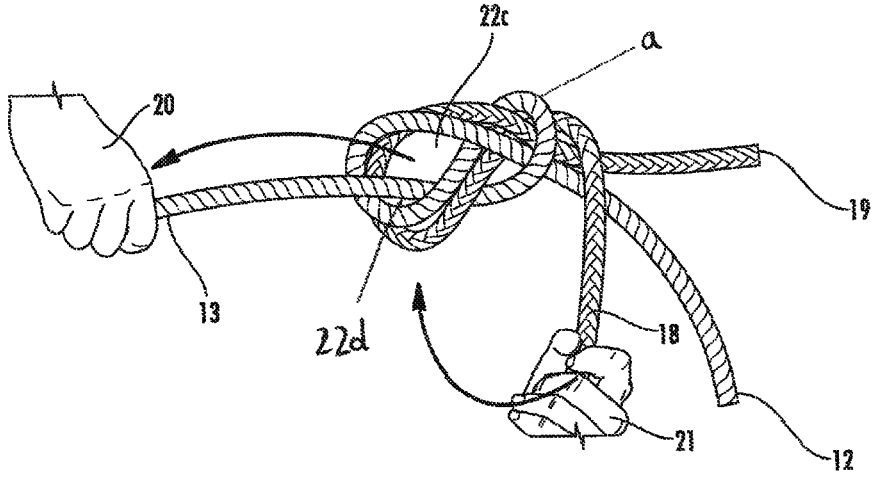

In FIG. 4 which depicts step 4, a second user 21 grasps the second material 15 having a proximal end 18 and a distal end 19 with the proximal end being the end that the user leads with and/or manipulates to complete the knot 10. Proximal end 18 is threaded through opening 22*a* and follows the path of the first material 11 in the proximal end to distal end direction such that the proximal end 18 is looped around portion c and threaded through opening 22*b* (see FIG. 5 which depicts step 5) and thereafter looped around portion a and threaded through opening 22*d* (see FIGS. 6 and 7 which depict steps 6 and 7).

Figure 8:
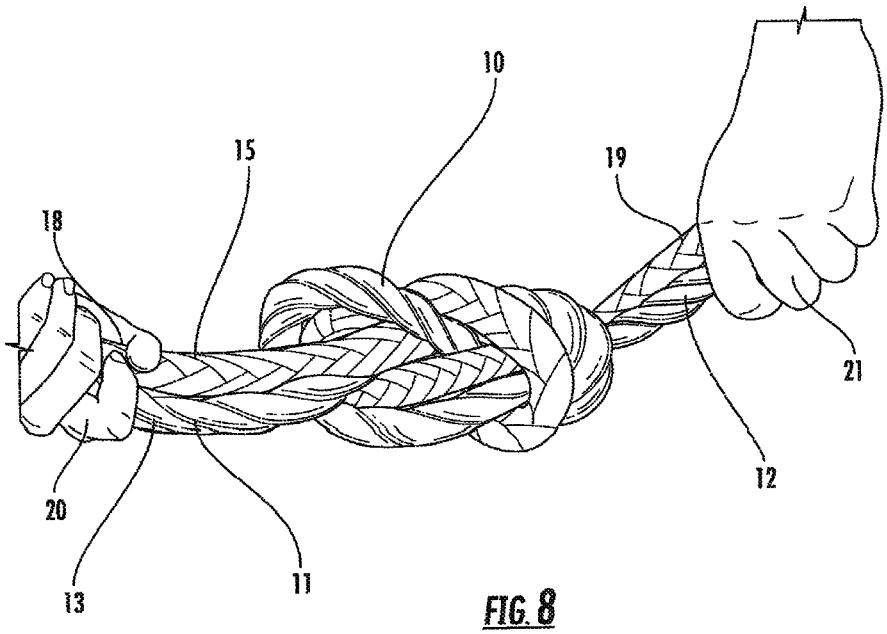

Once the proximal end 18 is threaded through opening 22*d*, the first and second materials are pulled and adjusted to align such that on one side of the knot 10, the distal end 13 of the first material lies substantially adjacent to the proximal end 18 of the second material and on the opposite side of knot 10, the proximal end 12 of the first material lies substantially adjacent to the distal end 19 of the second material, shown in FIG. 8 which depicts step 8.

Knot 10 is thus formed by the juxtaposition of the first and second knots formed by the first and second materials, respectively, and therefore may be referred to as a double knot. The second material 15 which is introduced at step 4 by user 21 (shown in FIG. 4) is shown to follow the path of knot 17 formed from the first material starting at proximal end 12, being initially threaded through opening 22*a*, and eventually ending at distal end 13 such that proximal end 18 of the second material is adjacent to distal end 13 of the first material. However, an identical knot 10 may be achieved by initially threading the proximal end 18 of the second material 15 through opening 22*c* and following the path of knot 17 until the proximal end 18 of the second material 15 is adjacent to the proximal end 12 of the first material 11.

Figure 9:
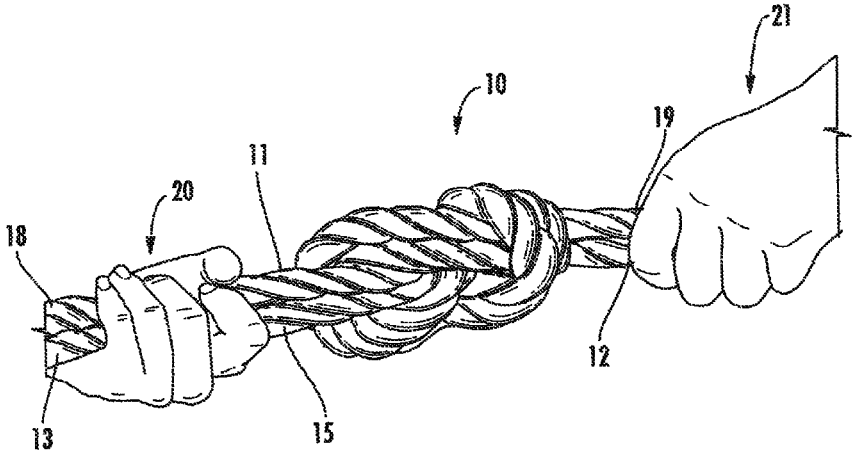
FIG. 9 illustrates the knot of the present invention in its final form as it is being tightened in an outward direction away from the knot by two individuals on either end of the knot, symbolizing the strength of their unity.

In a last step, one end of the first and second materials are grasped by each user respectively and pulled taut. FIGS. 8 and 9 illustrate this step, with the distal end 13 of the first material and the proximal end 18 of the second material being grasped by the first user 20, and the proximal end 12 of the first material and the distal end 19 of the second material being grasped by the second user 21. FIG. 9 depicts a situation where the first and second materials are substantially similar materials, whereas FIGS. 1-8 depict the first material as a twisted rope and the second material as a braided rope.

The first and second materials 11 and 15 may be provided in a kit to be used in a unity, wedding, vow renewal or other similar type of ceremony. The kit may contain a length of first material, a length of second material, and written and/or graphic instructions on how to form knot 10 during a unity or similar ceremony, optionally including at each step a recommended verse to recite by either the individuals participating in the ceremony or an officiant, thereby imparting meaning to the act of forming the knot. The instructions may be provided in hard copy form or digital form. The kit may be customizable depending on features desired by the users, such as the type/size of material used, enhancements to the material using a variety of embellishments, and the type of ceremony (i.e., wedding/civil union, vow renewal) being performed.

Figure 10:
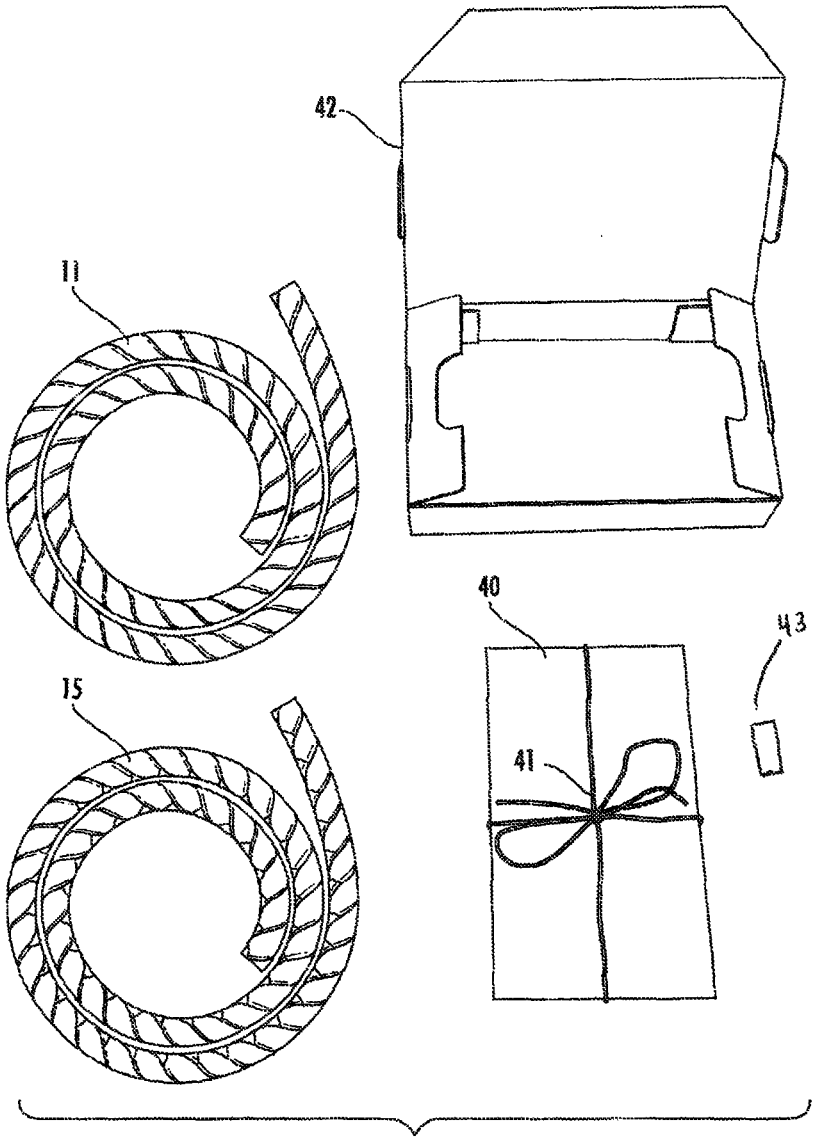
FIG. 10 illustrates a kit containing the materials to conduct the unity ceremony/knot tying ceremony. This kit is an example of the items which may be included and is not intended to be limited to the items shown.

FIG. 10 depicts a kit of the present invention which includes a first material and a second material, a box or packaging 42 and two cards 40 tied together by string 41. One card may include the sample ceremony wording for the officiant and users to read during the ceremony and the other card may have graphical instructions showing the steps of tying the knot 10. The kit may also include a means to preserve and/or display the knot, such as a shadow box, frame, stand, wall hooks, and the like. The kit may alternatively or additionally include a digital medium 43 with a video demonstration of forming the double knot and performing the ceremony. The digital medium may include a flash/usb drive, or any other type of external drive or digital medium to store a file. Alternatively, the kit may simply include an internet link to an online video demonstration or online written instructions for tying the knot. The instructions may also be sent to the user through the internet by electronic mail, electronic message, or the like, and therefore the written or graphical instructions are not required to be physically present in the kit.

For example, the ceremony wording may include a short introduction of the purpose of the unity knot ceremony. Next, the users participating in the ceremony may be asked to perform each of the eight steps depicted in FIGS. 1-8 in order to form the knot 10. After the knot is completed, the wording may include a concluding statement which explains the symbolism behind the ceremonious act performed by the couple.

During the ceremony, a number of family members or otherwise important people to the couple may participate in the knot forming ceremony. For example, family members may help the couple in the final tightening step of the ceremony, standing on either side of the knot.

The knot 10 formed by the users participating in the unity ceremony may be preserved, displayed and/or used as a keepsake that is passed down from generation to generation. For example, the knot may be mounted into a shadow box or frame. In another embodiment, the couple could renew their vows and symbolize the same by forming an additional knot to the one formed at their first ceremony.

While several particular forms of the invention have been illustrated and described, it will be apparent that various modifications and combinations of the invention detailed in the text and drawings can be made without departing from the spirit and scope of the invention. For example, references to materials of construction, methods of construction, specific dimensions, shapes, utilities or applications are also not intended to be limiting in any manner and other materials and dimensions could be substituted and remain within the spirit and scope of the invention. Accordingly, it is not intended that the invention be limited, except as by the appended claims.

We claim:

1. A method of forming a double knot representational of a union and commitment between a first individual and a second individual in a ceremony, comprising:

a) providing a first material having a proximal end and a distal end, and a second material having a proximal end and distal end b) forming a figure eight shape with the first material such that the proximal end of the first material overlaps with the distal end of the first material and the proximal end lies underneath the distal end, the figure eight comprising a first loop and a second loop which share a common point, wherein the first loop is continuous and the second loop is discontinuous;

c) threading the proximal end of the first material through the first loop;

d) pulling the distal end and the proximal end in opposite directions to form a first loose knot;

e) following the path of the first material with the second material to form a second loose knot that is adjacent to the first loose knot, forming a double knot; and, f) pulling the ends of the first and second materials taut to tighten the first and second knots.

2. The method of claim 1, wherein the first and second materials comprise rope, twine, yarn, thread, string, ribbon, wire, vinyl, nylon, rubber, leather, plastic, fabric, metal chain, braided metal rope or any combination thereof.

3. The method of claim 2, wherein the first and second materials are rope.

4. The method of claim 2, wherein the first material is a different color from the second material.

5. The method of claim 3, wherein the proximal and distal ends of the first and second materials are pre-treated by applying a glue, tape or adhesive thereon.

6. The method of claim 5, wherein the proximal and distal ends of the first and second materials are pre-treated by applying a glue, tape or adhesive thereon.

7. The method of claim 1, wherein the first material is grasped by the first individual during the steps of forming the first loose knot.

8. A kit for forming a double knot representational of a union and commitment between a first individual and a second individual in a ceremony, comprising a) a first material having a proximal end and a distal end;

b) a second material having a proximal end and a distal end;

c) optional verses to recite during the ceremony; and, d) written or graphic instructions for use comprising the following steps:

forming a figure eight shape with the first material such that the proximal end of the first material overlaps with the distal end of the first material and the proximal end lies underneath the distal end, the figure eight comprising a first loop and a second loop which share a common point, wherein the first loop is continuous and the second loop is discontinuous;

threading the proximal end of the first material through the first loop;

pulling the distal end and the proximal end in opposite directions to form a first loose knot;

following the path of the first material with the second material to form a second loose knot that is adjacent to the first loose knot, forming a double knot; and, pulling the first and second materials taut to tighten the double knot.

9. The kit of claim 8, wherein the instructions are provided in the form of an html address which provides the steps of forming the double knot.

10. The kit of claim 8, wherein the instructions are provided in the form of an html address which includes a video demonstration of forming the double knot.

11. The kit of claim 8, further comprising one or more photographs or drawings depicting one or more steps of forming the double knot.

12. The kit of claim 8, wherein the first and second materials comprise one or more of rope, twine, yarn, thread, string, ribbon, wire, vinyl, nylon, rubber, leather, plastic, fabric, metal chain, braided metal rope or any combination thereof.

13. The kit of claim 8, wherein the first and second materials comprise rope.

14. The kit of claim 8, wherein the proximal and distal ends of the first and second materials are pre-treated by applying a glue, tape or adhesive thereon.

15. The kit of claim 8, wherein the proximal and distal ends of the first and second materials are pre-treated by applying a glue, tape or adhesive thereon.

16. The kit of claim 8, wherein the first material is grasped by the first individual during the steps of forming the first loose knot.

17. A kit for forming a double knot representational of a union and commitment between a first individual and a second individual in a ceremony, comprising a) a first material having a proximal end and a distal end;

b) a second material having a proximal end and a distal end;

c) optional verses to recite during the ceremony; and, d) one or more digital media comprising written or graphic instructions for use comprising the following steps:

forming a figure eight shape with the first material such that the proximal end of the first material overlaps with the distal end of the first material and the proximal end lies underneath the distal end, the figure eight comprising a first loop and a second loop which share a common point, wherein the first loop is continuous and the second loop is discontinuous;

threading the proximal end of the first material through the first loop;

pulling the distal end and the proximal end in opposite directions to form a first loose knot;

following the path of the first material with the second material to form a second loose knot that is adjacent to the first loose knot, forming a double knot; and, pulling the first and second materials taut to tighten the double knot.

* * * * *